United States Patent [19]

Calder, Jr. et al.

[11] 4,085,676

[45] Apr. 25, 1978

[54] ELONGATED FLEXIBLE DETONATING DEVICE

[75] Inventors: Brooke J. Calder, Jr., Solon; Robert J. Belock, Wellston; Roger N. Prescott, Lyndhurst, all of Ohio

[73] Assignee: Austin Powder Company, Beachwood, Ohio

[21] Appl. No.: 746,825

[22] Filed: Dec. 2, 1976

Related U.S. Application Data

[62] Division of Ser. No. 582,993, Jun. 2, 1975, Pat. No. 4,024,817.

[51] Int. Cl.[2] ..... F42D 1/04

[52] U.S. Cl. ..... 102/23

[58] Field of Search ..... 102/22–24, 102/27

[56] References Cited

U.S. PATENT DOCUMENTS

| | | | |
|---|---|---|---|
| 3,236,180 | 2/1966 | Towle | 102/22 |
| 3,256,814 | 6/1966 | Kruppenbach et al. | 102/24 |
| 3,311,056 | 3/1967 | Noddin | 102/27 |
| 3,431,849 | 3/1969 | Kern et al. | 102/27 |
| 3,460,477 | 8/1969 | Heidemann et al. | 102/27 |

*Primary Examiner*—Verlin R. Pendegrass

*Attorney, Agent, or Firm*—Meyer, Tilberry & Body

[57] ABSTRACT

There is provided an elongated, flexible unitary detonating device of indeterminate length for detonating a selected explosive material within a bore hole. The detonating device includes, in combination, a detonating cord capable of detonating the selected explosive material when initiated while in direct contact with the selected explosive and a flexible energy absorbing layer formed around and carried by the detonating cord. The energy absorbing layer is formed from an energy absorbent material and has a radial thickness sufficient to preclude detonation of the selected explosive in direct contact with the energy absorbing layer when the detonating cord is initiated. In addition, an arrangement is provided for allowing stripping of the energy absorbing layer from the detonating cord at any selected position along the detonating cord to expose a portion of the detonating cord.

3 Claims, 14 Drawing Figures

FIG. 8
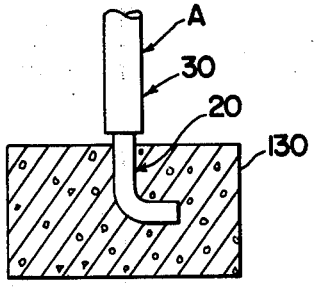
FIG. 9
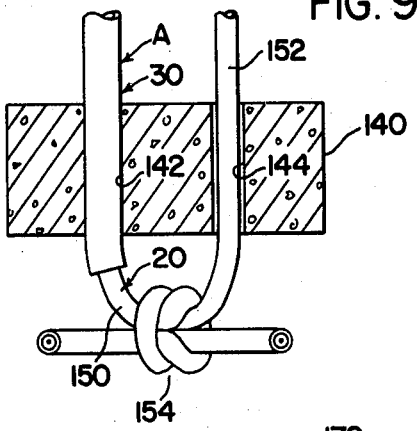
FIG. 10
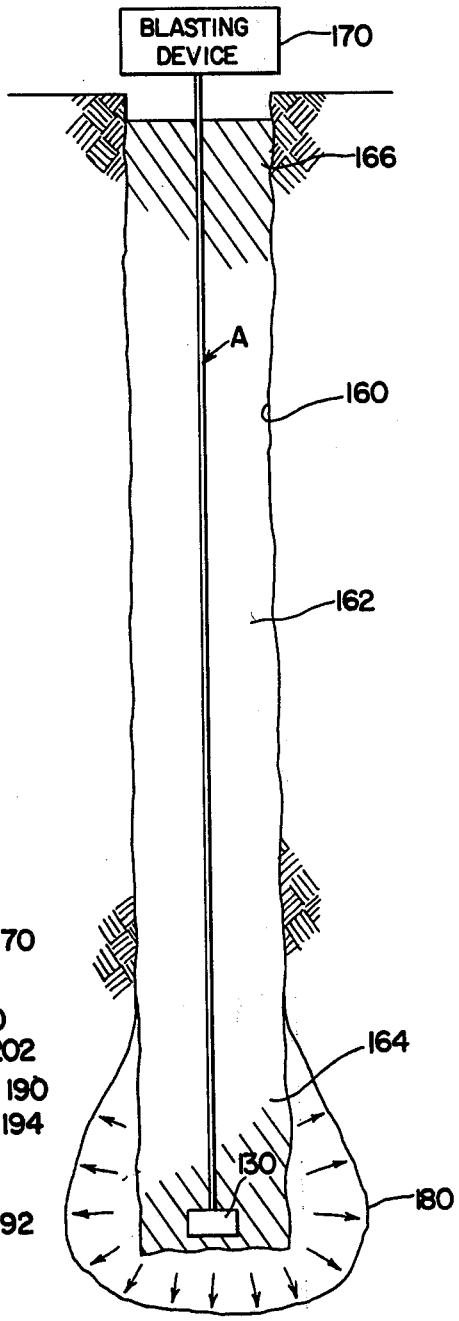
FIG. 11
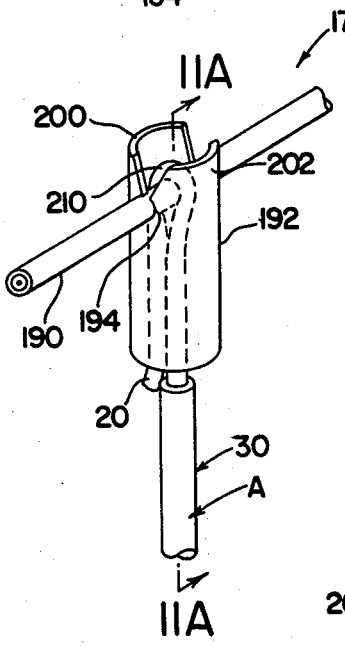
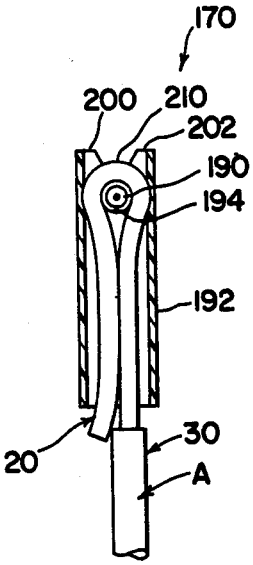
FIG. 11A

ELONGATED FLEXIBLE DETONATING DEVICE

This is a division of application Ser. No. 582,993 filed June 2, 1975, and now U.S. Pat. No. 4,024,817.

This invention relates to the art of detonating devices for explosives of the type placed in bore holes and more particularly to an improved elongated, flexible unitary detonating device for detonating from the bottom of a bore hole without using blasting caps or other highly sensitive explosives in the bore hole.

The present invention relates to an elongated detonating device, similar in appearance to a detonating cord, which device is primarily used for bottom detonation of non-cap sensitive explosives, such as NCN and certain slurries, placed in a bore hole. The invention will be described with particular reference to this application; however, the invention has broader uses and may be employed for detonating certain cap sensitive explosives.

BACKGROUND OF INVENTION

In many explosive applications, a series of elongated, deep bore holes are provided in the material to be fragmented. Such bore holes are filled with an explosive material which is chosen on the basis of explosive characteristics and cost. In many instances, NCN and a variety of slurries are used as an explosive material because of their low cost. When these explosives are used, dynamite or cast primers are the commonly employed detonating devices. It has long been known that substantially more energy can be transmitted to the surrounding burden, if the explosive in the bore hole is detonated from a lower position. Consequently, substantial development work has been devoted to systems for detonating the explosive column at a lower position of a bore hole. The most widely used system for this purpose involves the use of an electric blasting cap. An electric blasting cap includes a housing having an explosive charge, which is capable of being detonated by an electrically heated resistance wire connected to two wires known as "leg wires". The leg wires extend from the blasting cap to a remotely located source of electrical current. When using this type of detonating system, the electrical blasting cap can be positioned below the surface of the explosive column within a bore hole with the leg wires extending from the blasting cap, through the explosive column and to any remote position. A current source applied across the leg wires fires the blasting cap and detonates the explosive column. This type of electrical system has proven quite useful for lower detonation of bore holes; however, certain disadvantages have become apparent. In blasting locations, electrically operated equipment is often used for various non-blasting work. Many times ground cables must carry electrical current for operation of such equipment. In addition, certain equipment generates electrical current for use by the equipment itself. Since the blasting sites are exposed to atmospheric condition, it is possible to experience lightning and static electricity conditions. It has also been found that when a number of leg wires are connected for simultaneous detonation of several bore holes, these conductive wires can form receiving antennas which will generate electrical currents when exposed to electromagnetic energy sources, such as radio transmitting antennas. All of these sources of stray electricity present a potential for inadvertent detonation of electrically actuated blasting caps after the caps are placed into bore holes. To overcome the possibility of inadvertent detonation by stray electricity at a blasting site, expensive precautions are required.

Because of the disadvantages of electrical blasting caps, it is somewhat common practice to detonate the upper portion of the explosive column in bore holes. In this manner, standard detonating cord can be used with a primer located at the upper portion of the explosive column. The disadvantages of electrical blasting caps are avoided; however, the additional explosive strength experienced with lower detonation of the explosive column is not obtained. To realize the benefit of lower detonation without using an electrical system, substantial effort has been devoted to development of a positive nonelectrical system for detonating explosive columns at a position deep in a bore hole.

If a standard detonating cord, which does not present the basic disadvantages of an electrical system, is extended through an explosive column in a bore hole filled with NCN, slurry, dynamite or other explosive material, the explosive column is detonated from the top when the detonation wave in the cord reaches the explosive. This is due to the fact that the explosive wave of standard detonating cord is sufficiently strong to explode non-cap sensitive explosives in direct contact with the cord. For this reason, standard detonating cord can not be used for lower detonation of explosive columns in the confinement of bore holes.

To provide lower detonation of explosive columns, certain modifications have been made in detonating cord. The first proposed modification of detonating cord has been the development of a low energy detonating cord, often known as LEDC, which includes a small continuous lead tube filled with standard high explosive material with an approximate distribution or load of 1–2 grains per linear foot. This compares with a standard distribution of 15–40 grains per linear foot for "economy" cord and over 50 grains per linear foot for reinforced cord. By using this low explosive loading, in a flexible lead tube, sufficient detonating energy is created at a cut end of the tube for the purpose of initiating a blasting cap. As is known, a blasting cap is a standard component having a small primary, highly sensitive charge for converting a relatively small detonating force, such as created by a low energy cord, into a higher force for detonating a secondary charge. The secondary charge has sufficient bulk to detonate the explosive in a bore hole. This type of system requires a good physical contact between the lead tube and primary charge of the blasting cap. To assure a sound connection to the lead tube, the blasting cap is generally secured onto the detonating cord by a relatively expensive manufacturing operation performed at the manufacturer's plant. Consequently, the cap and cord must be purchased as a unit with the approximate length of cord being attached. If the cord length is not proper, it is not possible to splice the cord for changing its length. This caused difficulties in the field. This low energy type of system can be used for lower detonation if the proper connections are made at the initiating end and the blasting cap end. However, because of the sensitivity required to initiate this detonating cord, this system does not produce uniform results. If the blasting cap is not initiated after placed in a bore hole, it remains at the bottom of the bore hole in a dormant condition. As is well known, care must then be taken if the blasting cap is to be removed. Since the blastinc cap includes a very sensitive primary charge an inadvertent blow can detonate the cap and any explosive adjacent thereto. Because of the uncertainty of ignition, the possibility of leaving a dormant blasting cap in the bore hole, and the high expense of this type of system, this system has not proven the solution to the problems outlined above, although the low energy wave of the detonating cord does allow it to pass through certain explosive material to the lower portion of an explosive column in a bore hole.

To overcome the disadvantage of requiring a demanding physical contact between the low energy detonating cord at both ends thereof and the cost contaminant thereto, a further type of lower energy detonating cord has been developed using the concept of a hollow plastic tube with the inner walls of the tube coated with a slight amount of high explosive material. This second type of low energy detonating cord is described in U.S. Letters Pat. No. 3,590,739. Approximately 0.5 to 2.4 grains per linear foot of explosive material is used on the inside surface of a hollow plastic tube for detonating purposes. By using this structure, it is possible to extend the hollow detonating cord through an explosive column to a lower portion of a bore hole; however, since relatively low energy is created by the small amount of high explosive within the cord, this system again requires a sensitive blasting cap in the bore hole itself. By requiring a blasting cap in the lower portion of the bore hole, as required in the first low energy type of detonating cord, a very sensitive primary charge is used in connection with a secondary primer charge. Thus, if detonation does not occur, expensive precautions are necessary to remove the blasting cap at the bottom of a bore hole.

The two prior attempts to provide a blasting cord which can pass through the explosive charge of a bore hole for lower detonation thereof each have common disadvantages. They are both predicated upon the theory that a minute distribution or load of high explosive within the cord, less than about 4 grains per linear foot, is the proper procedure for preventing detonation of the charge as the cord is exploded through an explosive. The reduction of loading in the core of a blasting cord for reducing the probability of premature detonation in a bore hole causes substantial disadvantages. First, each low energy system requires a blasting cap in the bore hole. The low energy cord has insufficient usable energy for detonating a cast primer without a highly sensitive charge found in a blasting cap. Since these low energy cords use the concept of reduced available energy, detonation is less positive, especially in the variable ambient conditions within a bore hole. Another distinct disadvantage of low energy cord is the inherent inability to transmit a detonating wave to or from a standard detonating cord. Consequently, it is not practical to provide a standard detonating cord as a trunk line for direct connection to a low energy cord forming a down line of a bore hole. Thus, to initiate the low energy detonating cord, a strong positive initiating force must be exerted on the cord itself. This results in complications when multiple bore holes are to be shot simultaneously. In addition, low energy cords can not detonate from one cord to another. Thus, splicing of such cords is not practical. With all of the disadvantages inherent in using low energy detonating cord, relatively expensive blasting equipment is required and substantial expense is incurred by using such cord. Additional expenses are incurred to assure the safety of the site when an attempted detonation by low energy cord fails.

SUMMARY OF INVENTION

The disadvantages of prior attempts to provide a detonating cord which will detonate an explosive column within a bore hole at the lower position thereof are completely overcome by the present invention which relates to an elongated, flexible unitary detonating device of indeterminate length, which device has insufficient transverse energy to detonate an explosive column in a bore hole when the detonating device is extended through the bore hole to a lower position. The invention has sufficient strength to provide a positive detonation at the lower portion of the bore hole without requiring an intermediate energy increasing charge, such as found in conventional blasting caps.

In accordance with the present invention, there is provided an improvement in a detonating cord having an outer surface and including a center core of particulate high explosive material, a tensile strength increasing layer surrounding the core and a moisture impervious layer surrounding the core. This improvement involves the use of an energy absorbing layer surrounding the outer surface of the detonating cord and releasably secured thereto. By utilizing an energy absorbing layer surrounding the outer surface of a detonating cord, it is possible to preclude detonation of an explosive column in a bore hole, even though the cord extends through the explosive to the bottom part of the bore hole. By releasably securing this energy absorbing layer onto the aforementioned outer surface of a detonating cord, it can be stripped at both the upper and lower ends so that a detonating wave may be initiated in the cord by either another standard detonating cord or other appropriate blasting machines. In the lower portion of the bore hole, exposure of the inner cord by stripping of the energy absorbing layer therefrom allows a substantial increase in the transversely transmittable energy usable for detonation. By this arrangement, lower detonation of a bore hole is made possible without the distinct disadvantages experienced when using low energy types of detonating cord having a grain load of less than about 4 grains per linear foot.

In accordance with another aspect of the invention, there is provided an elongated, flexible unitary detonating device of indeterminate length for detonating a selected explosive material within a bore hole. The detonating device includes, in combination, a detonating cord capable of detonating the selected explosive material when initiated while in direct contact with the selected explosive; a flexible energy absorbing layer formed around and carried by the detonating cord, with the energy absorbing layer being formed from an energy absorbent material and having a radial thickness sufficient to preclude detonation of the selected explosive material when in direct contact with the energy absorbing layer while the detonating cord is initiated; and, means for allowing manual stripping of the energy absorbing layer from the detonating cord at any selected position along the detonating cord.

In accordance with the preferred embodiment of the invention, the arrangement for allowing stripping of the energy absorbing layer from the internal detonating cord is a loosely woven yarn covering the outer surface of the detonating cord and covered by an extrusion of plastic which does not extend through the yarn and into fixed engagement with the surface of the detonating cord. With this arrangement, any section of the elongated element may be circumferentially cut and stripped to expose the internal detonating cord, which cord is sufficiently high in explosive force to detonate the explosive through which the cord extends. The loosely woven yarn provides a cushion between the outer surface of the inner detonating cord and the outer plastic extrusion over the layer of yarn. This cushion of compressible loosely woven yarn completely surrounding the inner detonating cord absorbs a certain amount of transversely transmittable energy, even though the yarn layer serves the primary function of a separating seam or joint between the energy absorbing layer and the inner cord. The outer plastic energy absorbing layer, which is relatively thick, coacts with the yarn to dampen and reduce the transmitted energy available when the inner detonating cord is initiated.

In accordance with the invention, the inner detonating cord can have an explosive core with a longitudinal distribution of particulate high explosive material in the general range of 6–20 grains per linear foot. In practice, the explosive distribution is approximately 11-13 grains per linear foot. As can be seen, this type of cord, although it provides the bottom detonation characteristics, does not utilize the concept of reduced available energy, as previously used for lower detonation of bore holes. Thus, the present invention is a departure in kind from prior attempts to develop a nonelectrical cord which will extend through a column of explosive in a bore hole for bottom detonation.

In accordance with another aspect of the invention, the above mentioned invention is connected to a standard cast primer in the lower portion of a bore hole by a unique connecting arrangement wherein the energy absorbing layer of the invention is stripped from the lower end of the detonating element and tied to a standard detonating cord which can be threaded upwardly through the explosive column and through secondary cast primers for successive upper detonation of the column after an initial lower detonation. The prior low energy detonating cords for bottom detonation could not be used for this purpose since they can not, by themselves, transmit a detonating wave to or from a standard cord.

In addition, by using the present invention, a standard cord may be provided as a trunk line with the down lines formed from the invention. This is made possible by stripping the releasable energy absorbing layer from a selected upper portion of the invention and then intimately connecting this stripped portion with a standard detonating cord trunk line. The standard detonating cord will initiate the invention, which forms the down line to each bore hole.

The primary object of the present invention is the provision of an elongated, flexible detonating device, which device can extend through an explosive column in a bore hole for lower detonation of the column.

Another object of the present invention is the provision of an elongated, flexible detonating device, which device can extend through an explosive column in a bore hole for lower detonation of a column, without using a blasting cap at the point of detonation.

Still a further object of the present invention is the provision of an elongated, flexible detonating device, which device can extend through an explosive column in a bore hole for lower detonation of a column without requiring a high sensitivity primary charge for detonating a secondary primer charge preparatory to detonation of the column.

Another object of the present invention is the provision of an elongated, flexible detonating device, as defined above, which device does not depend primarily upon the use of small core loading for its ability to fire through a portion of an explosive column in a bore hole without detonating the column.

Yet another object of the present invention is the provision of a detonating device as defined above, which device can transmit a detonating wave to and from a standard detonating cord.

Yet another object of the present invention is the provision of a flexible detonating device as defined above, which device includes an outer layer of an energy absorbing material formed as a unit onto an inner detonating cord, but selectively releasable from the cord.

These and other objects and advantages will become apparent from the following description taken together with the accompanying drawings.

BRIEF DESCRIPTION OF THE DRAWINGS

In the drawings accompanying this specification:

FIG. 8 is a partial, schematic, partially cross-sectioned view illustrating one type of connection between the present invention and a somewhat standard cast primer;

FIG. 9 is a view similar to FIG. 8 showing another arrangement for connecting the present invention with a cast primer and illustrating the feature of the invention allowing transmission of a detonation wave to a standard detonating cord;

FIG. 10 is a schematic, cross-sectional view showing a blasting system using the preferred embodiment of the present invention;

FIG. 11 is a pictorial view showing a connection between the present invention and a trunk line using a standard detonating cord;

FIG. 11A is a plan view showing the structure illustrated pictorially in FIG. 11;

PREFERRED EMBODIMENT OF THE INVENTION

Figure 1:
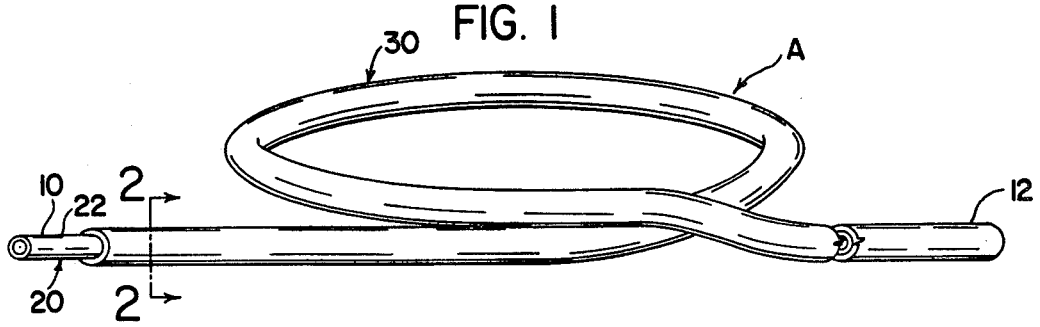
FIG. 1 is a pictorial view showing the preferred embodiment of the present invention.

Referring now to the drawings wherein the showings are for the purpose of illustrating a preferred embodiment of the invention only, and not for the purpose of limiting same, FIG. 1 shows an elongated, flexible unitary detonating device or element A constructed in accordance with the present invention which element can be wrapped, tied and otherwise used in the same manner as a standard detonating cord. Detonating element A includes an indeterminate length which can be cut to provide two longitudinally spaced ends 10, 12, one of which can be connected to a standard initiating device and the other to a primer or other element to be detonated. In accordance with the invention, detonating element A includes an inner detonating cord 20 having an outer surface 22 and constructed in accordance with somewhat standard practice in the detonating cord art. Cord 20 is used for transmitting a detonating wave by high explosive particles, as in a standard detonating cord. Surrounding surface 22 of detonating cord 20 there is provided an energy absorbing layer, or sheath, 30 which functions to reduce the transverse transmitted energy caused during initiation of detonating cord 20, so that detonating element A can extend through a column of explosive material, such as NCN and/or slurry, without detonating the same.

Referring now more particularly to the somewhat standard inner detonating cord 20, this cord is constructed in accordance with normal manufacturing techniques such as those described in U.S. Pat. No. 3,726,216, which is incorporated by reference herein. The detonating cord 20, in the preferred embodiment of the invention, differs from the cord specifically disclosed in this prior patent in certain respects. For instance, detonating cord 20 has an explosive distribution or grain load in the general range of 6–20 grains per linear foot, whereas the disclosed detonating cord in the prior patent has a grain load generally in excess of 15 grains per linear foot. In addition, with the lesser explosive distribution or grain loading, particles of explosive material, as will be explained later, are smaller in the present invention than in this prior patent. The outer textile wrapping of thread coated with a wax for tying purposes shown in the prior patent is omitted in the preferred embodiment of the present invention. It is appreciated that such a wrapping could be incorporated in the invention without departing from the intended scope.

Inner detonating cord 20 of the present invention includes the centrally located explosive core 40 formed around a feed assisting thread or string 42 which enhances gravity feeding of the high explosive particulate material forming core 40. In practice, core 40 is formed from small particles of pentaerythritoltetranitrate (PETN), cyclotrimethylenetrinitramine (RDX), cyclotetramethylenetetranitramine (HMX), tetryl, ditrinitroethylurea, trineitrotoluene (TNT) and mixtures thereof. In the preferred embodiment of the present invention, Class II Trojan (PETN) is used. This material has a grain size which allows a majority amount by weight of the PETN particles to pass through a 325 United States Standard screen. Indeed, this material actually allows most of the PETN particles to pass through this relatively small screen to enhance the wave propagation characteristics of core 40 after initiation. The particle size of the PETN in the preferred embodiment is applicable for grain loading of approximately 6–12 grains per linear foot. If higher loading is used in detonating cord 20, a correspondingly larger PETN grain size could be used with an increase in the ease of feeding the particles into the core. As explained in the prior patent, the PETN particles are first dried and then treated with an appropriate flowing or anti-static agent and an anti-wicking agent which are well known in the art. These agents facilitate easier gravity feed of the small particles around thread or string 42 and into core 40 during the formation of detonating cord 20, in accordance with standard practice and with standard detonating cord manufacturing equipment.

In accordance with somewhat standard practice, core 40 is supported by a carrier or tube 50 formed from longitudinally wrapped fibrous material, such as Crepe paper. Carrier or tube 50 provides a means for forming core 40 into a continuous flexible column which allows propagation of a detonating wave therethrough. Although Crepe paper having a width of approximately ¼ inch and thickness of approximately 0.002–.005 inches is employed in the preferred embodiment, other appropriate supporting material could be used, such as plastic or fiberglass tape or ribbon. Disposed around the carrier 50 is a textile layer 52 which is used for increasing the tensile strength of detonating cord 20. This fibrous or textile layer 52 may include ten strands of thread wrapped around carrier 50. These strands can be formed from continuous lengths of various fibrous materials such as cotton, rayon, jute and the like. In practice these strands have about 1500 filaments and a weight in the range of from about 1,100 to about 2,200 Denier. To further increase the tensile strength of detonating cord 20, it is possible to wrap, in an opposite direction, a second layer of textile material over the first layer 52, although this is not illustrated in the preferred embodiment of the invention. Around tensile strength increasing layer 52, there is provided a moisture barrier 60 formed from 8 mils of polyethylene extruded around textile layer 52 and forming a moisture impervious barrier preventing moisture from contaminating the PETN of core 40. Of course, other extrudable materials, both plastic and elastomeric, could be used to provide the moisture barrier for core 40. Although polyethylene is used in the preferred embodiment, polyvinylchloride and polyethylene terethphalate or the like is also appropriate as a barrier. In accordance with normal practice, barrier 60 is extruded around core 40, although it is possible to use a ribbon or tape wrapped around fibrous layer 52 to provide this barrier. As so far described, barrier 60 defines the outer surface 22 of detonating cord 20.

Although the high explosive material in core 40 may have a grain load or explosive distribution in the general range of 6–20 grains per linear foot, in the preferred embodiment of the invention, the grain load is about 11–13 grains per linear foot. In the example to be provided later, the grain loading is 11.8 grains per linear foot. As can be seen, generally the grain loading of detonating cord 20 is below grain loading of a standard detonating cord and above the grain loading of low energy detonating cord. There may be a slight amount of overlap between the lower loading for economy cord and the upper limit of the preferred loading of the present invention. When the present invention approaches a loading of 15–20 grains per linear foot the energy absorbing layer 30 becomes relatively large. This reduces the economy of the invention and creates a relatively large channel through the explosive column. For these reasons, the upper practical limit of the invention may be approximately 20 grains per linear foot; however, higher loading is possible without departing from the invention if the remaining criteria are observed. The lower limit of grain loading is substantially above the previous low energy detonating cord. As will become apparent, cord 20 functions, for initiation and detonation purposes, as a standard cord. With loading less than about 6 grains per linear foot, special boosters and equipment, not contemplated by this invention, would be required. Indeed, loading below about 6 grains per linear foot would preclude needed initiation by a standard cord.

As so far explained, detonating cord 20 is constructed in accordance with well known detonating cord technology. In the manufacture of detonating cord, often surface 22 is provided with a thin thread wrapped around the surface and coated with a wax. This thread is used to facilitate tying of the detonating cord which is easier when a waxed thread coating is used. Although this thread coating could be used in the present invention, it is not contemplated in the preferred embodiment.

The cord 20, which is constructed in accordance with standard practice, includes a sufficient high explosive grain loading to guarantee detonation of a standard 40-50 grain detonating cord when the cord is intimately associated with outer surface 22 by a knot or other cord connecting arrangement. Since cord in some instances may have a grain load as low as 15 grains per linear foot, the loading of core 40 may be increased to initiate to or from this low load cord; however, generally core 40 is loaded to initiate to or from a 40–50 grain cord. In practice, it has been found that a grain loading of 11–13 grains per linear foot will detonate a 40–50 grain detonating cord when a 8 mil barrier 60 is used for the cord 20. With this loading of the high explosive particles, cord 20 would have sufficient transverse detonating energy to detonate an explosive in a bore hole, such as a blasting agent or slurry. Consequently, cord 20 by itself can not be used for bottom detonation of explosive columns in bore holes. In accordance with the present invention, cord 20 is provided with an outer energy absorbing layer 30 releasably secured to surface 22. Energy absorbing layer 30 has sufficient energy absorbing characteristics, based upon the required loading of core 40, the material of layer 30 and the thickness of the layer 30, to prevent detonation of an explosive charge through which element A extends. This energy absorbing layer will be modified according to the core loading required to obtain positive initiation and detonation for a particular application. If initiation is to be by a low loaded cord, core 40 will have a higher loading and layer 30 will have a high energy absorbing capability. A variety of energy absorbing layers could be provided for meeting this requirement. In a like manner, a variety of arrangements can be used for allowing selective removal of the energy absorbing layer from certain portions of element A to initiate the element and, when necessary, to detonate a cast primer or other detonating device in the bottom of a bore hole.

Figure 2:
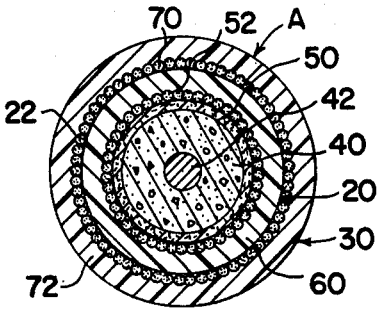
FIG. 2 is an enlarged cross-sectional view taken generally along line 2—2 of FIG. 1.

In accordance with the preferred embodiment of the invention, the energy absorbing layer 30 is formed from a heavier layer of plastic material which is the same as the plastic material forming barrier 60. This heavier layer is extruded around detonating cord 20 with a thickness of 35-45 mils. In practice, the nominal thickness is approximately 42 mils. To allow stripping of the energy absorbing layer from selected areas of element A, there is provided a layer of fibrous material 70, which layer is formed from rayon, cotton or other yarn. The primary function of layer 70 is to prevent tight adhesion between energy absorbing layer 70 and surface 22. In practice, a loosely woven rayon yarn designated 20/2 is used to create a separating seam 80 between the energy absorbing material and surface 22. This rayon yarn is formed from a number of short naps twisted together in two strands so as to create a loosely woven fiber layer 70 which is wrapped around surface 22 and does not fixedly adhere thereto. Layer 72 forms the primary energy absorbing structure of layer 30 and is extruded around the wrapped yarn layer 70. The plastic in layer 72 does not extend through the yarn layer and into adhesion with layer or barrier 60. Since the yarn forming layer 70 is loosely woven with numerous twisted short naps, this layer has an energy absorbing characteristic of its own. This is a secondary function of layer 70. The space between plastic layers 60, 72 which is filled by yarn layer 70 has voids that dissipate energy attempting to be transmitted through this space. In some instances, it would be possible to provide between layers 60, 72 a yarn or thread similar to that provided in fibrous layer 52. This would prevent adhesion between plastic layers 60, 72; however, would be more expensive and would provide less additional energy absorption. The preferred embodiment includes the loosely woven type of yarn for its added energy absorbing characteristics. In addition, since this yarn sticks to neither layer 60 nor layer 72, the loosely woven yarn provides a convenient means for releasing outer energy absorbing plastic layer 72 from cord 20. This construction of element A is schematically shown in FIG. 2.

Figure 3:
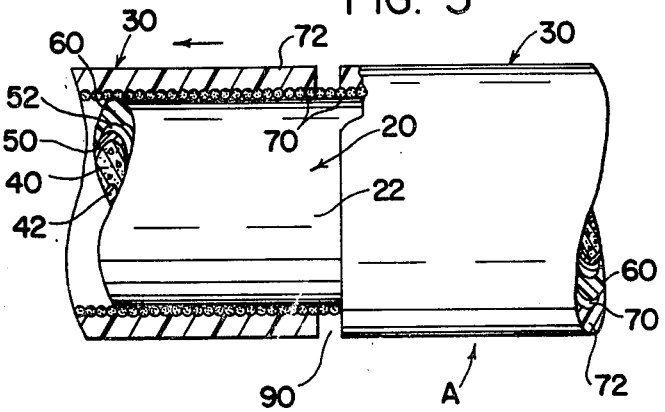
FIG. 3 is an enlarged, partial cross-sectioned view illustrating the stripping characteristics of the present invention.

To remove energy absorbing layer 30, and more particularly the heavier plastic tubular extrusion 72, from cord 20 it is only necessary to manually cut layer 72 circumferentially as indicated by cut 90 in FIG. 3. This cut may be only partially through layer 72 and partially around the circumference of layer 30. After a cut around about ¾ of layer 30 is made, element A can be flexed at the cut to break away plastic layer 72. Thereafter, the layer may be slipped from the end of element A, as shown in FIG. 3. This leaves only the fibrous strands in layer 70 surrounding an exposed portion of cord 20. These strands may then be cut away or unwoven from surface 22 and pulled away from the surface so that cord 20 may be tied to a trunk line or other initiating system. Cut 90 is generally made approximately 6–12 inches from an end of element A so that the exposed portion of cord 20 is sufficiently long to form a connection.

Figure 4:
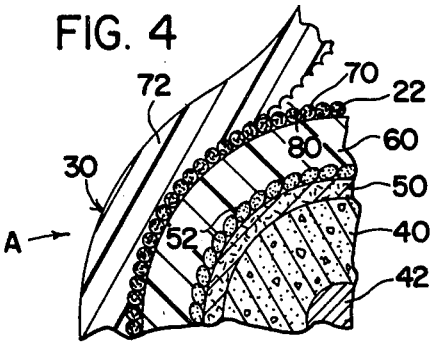
FIG. 4 is an enlarged, partial cross-sectional view illustrating the stripping characteristics of the preferred embodiment.
Figure 5:
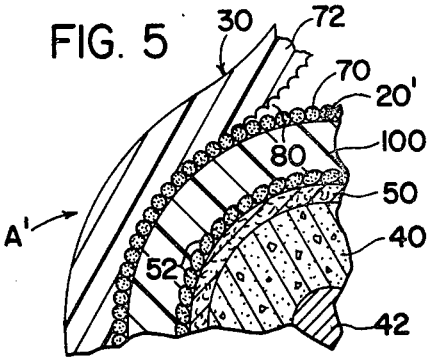
FIGS. 5, 6 and 7 are enlarged, partial cross-sectional views similar to FIG. 4 showing modifications of the preferred embodiment of the present invention.
Figure 6:
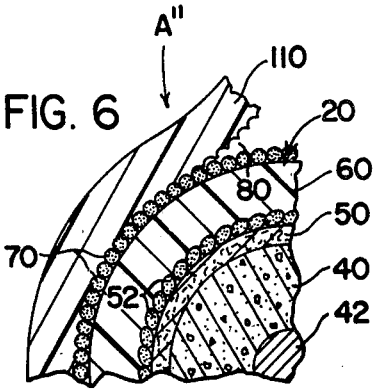
Figure 7:
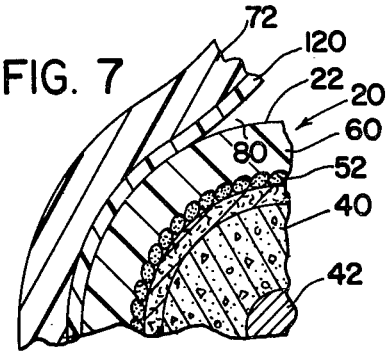

FIG. 4 illustrates the releasing characteristic between layer 72 and barrier 60 at seam 80. In practice, an axial release is used instead of the illustrated circumferential release which would be possible by making a longitudinal cut and a circumferential cut. A view similar to FIG. 4 illustrating a modification of the preferred embodiment of the present invention is shown in FIG. 5 wherein elongated flexible element A′ includes an inner detonating cord 20′ which differs from cord 20 by including an elastomeric barrier 100 instead of a plastic barrier 60, as used in the preferred embodiment. This elastomeric barrier could be tar, asphalt or other similar water impervious material coated or extruded around carrier 50. Except for this change in detonating cord 20, element A′ is substantially the same as the preferred embodiment of the invention. A further modification is illustrated in FIG. 6 wherein an elongated flexible detonating element A′ is provided with an inner detonating cord 20 corresponding to the detonating cord of the preferred embodiment. The outer energy absorbing plastic layer 72 of the preferred embodiment is replaced by an elastomeric energy absorbing layer 110. This layer has sufficient thickness to perform the function attributed to energy absorbing layer 72 of the preferred embodiment. A further modification of the preferred embodiment is illustrated in FIG. 7. In this modification, an inner detonating cord 20 is formed in accordance with the preferred embodiment of the invention. The outer plastic energy absorbing layer 72 is releasably secured to surface 22 of cord 20 by a releasing material 120 which may be a plastic having a dissimilar melt index from plastic of layers 60, 72. Other materials could be provided between the energy absorbing layer 72 and barrier 60. Indeed, it is possible that the two plastic materials forming the energy absorbing layer 72 and barrier 60 could be so dissimilar that they would not adhere. When this type of structure is used, the space between layers 60, 72 is not filled by a fibrous layer. Thus, it may be difficult to slip the severed portion of the energy absorbing layer from the end of the detonating element. In that instance, a longitudinal cut may be used or required to sever the energy absorbing layer from the inner detonating cord. It is apparent that various modifications are possible in the preferred embodiment of the invention without departing from the intended spirit and scope of the invention. For instance, various energy absorbing layers, releasing arrangements and detonating cords can be used to obtain the desired results of the invention. In all instances, the flexible elongated detonating element is a unitary structure which can be wrapped on a reel and transported to a blasting site in accordance with standard transportation procedures for detonating cord. Thus, the two element structure is a unitary structure until the stripping process is performed.

FIG. 8 illustrates a connection between the detonating element A and a standard cast primer 130. In this illustrated arrangement, the lower portion of element A is stripped to expose inner detonating cord 20. This cord is then molded into the cast primer 130 for subsequent use in the bottom of the bore hole in a manner to be explained later.

FIG. 9 shows another aspect of the invention wherein an improved connection is provided between detonating element A and a standard cast primer 140 having the usual axial bores 142, 144. Element A is stripped at portion 150 to expose inner cord 20, which is connected to a standard 50 grain detonating cord 152 by an appropriate knot 154 or other connecting arrangement. Standard detonating cord 152 extends upwardly through bore 144 for a purpose to be explained later. When detonating element A is initiated, it may have sufficient transverse energy to detonate primer 140. If detonation does not occur, then the exposed detonating cord will positively detonate the higher energy standard detonating cord 152 for positive detonation of primer 140 and any additional primers located along cord 152.

Referring now to FIG. 10, cast primer 130 shown in FIG. 8 is positioned at the bottom of a bore hole 160 filled with a column 162 of explosive material, such as NCN, TNT, slurry, etc. The column and bore hole have a lowermost end 164 and an uppermost end 166. Cast primer 130 is positioned adjacent lowermost end 164 and element A extends through the explosive column 162 to an upper blasting device 170 adjacent the uppermost end 166 of the bore hole. The blasting device is only representative and element A may be initiated by a trunk line, an electric initiator or other appropriate device. Before element A can be initiated, the upper portion has the energy absorbing layer 30 stripped. In this manner, positive initiation to the inner detonating cord 20 is possible. Upon initiation of element A, a lower detonation 180 occurs adjacent lowermost end 164 of bore hole 160.

As shown in FIG. 11, the blasting device 170 of FIG. 10 may be a standard trunk line 190 extending over bore hole 160. Element A forms the down line from the trunk line. A connector 192, including diametrically opposite openings 194 and flexible lips 200, 202, is used to connect a bight 210 of cord 20 with the trunk line. This can be done by extending one end of element A through connector 192 and then forming bight 210 around trunk line 190. The free end of element A is then threaded through the connector and the connector is shifted upwardly to engage trunk line 190 and resiliently hold detonating cord 20 in tight, intimate wave transmitting contact with the trunk line. In this manner, the standard trunk line can be used to detonate a down line formed in accordance with the preferred embodiment of the present invention.

Figure 12:
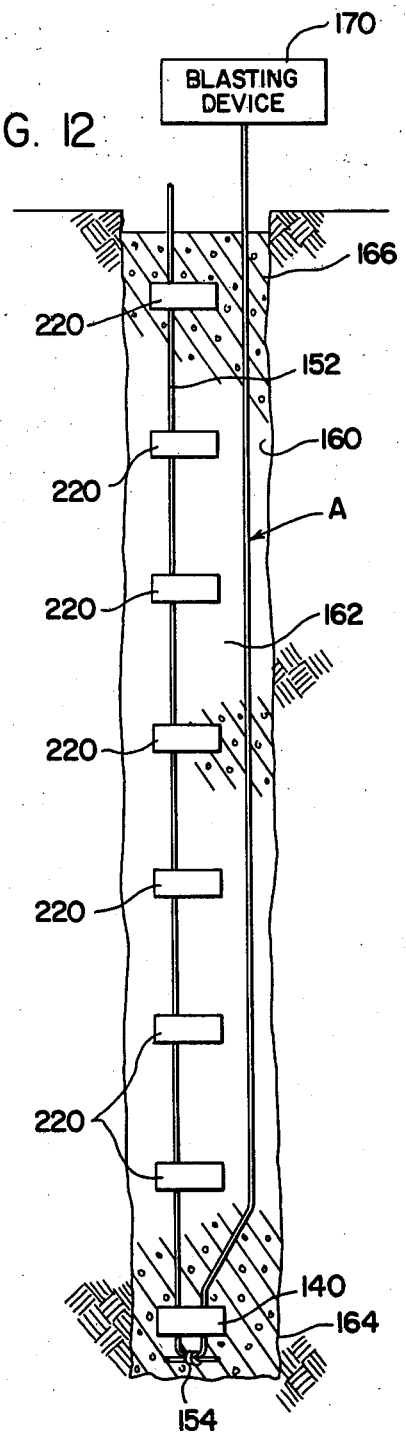
FIG. 12 is a view similar to FIG. 10 illustrating a blasting system using a further aspect of the present invention; and, FIG. 13 is a view similar to FIGS. 10 and 12 illustrating still another system using the present invention for a decking type of bore hole charging.
Figure 13:
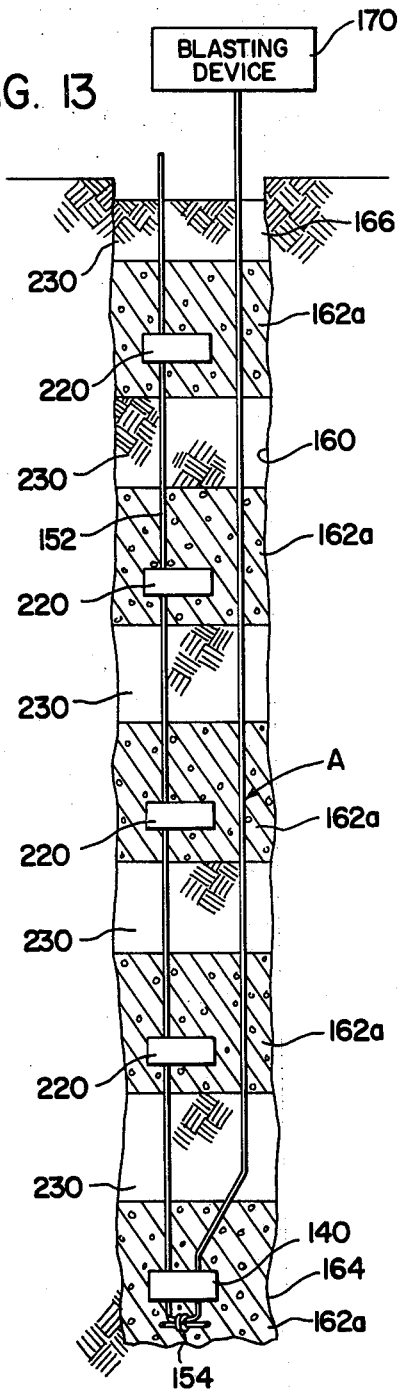

Referring now to FIG. 12, a system utilizing the present invention is illustrated. In this system, the cast primer 140, as shown in FIG. 9 is positioned at the lowermost end 164 of bore hole 160. An initiating or blasting device 170 can be used for bottom detonation of cast primer 140. In accordance with the illustrated system, a plurality of axially spaced secondary primers 220 are positioned in the bore hole. Standard detonating cord 152 is threaded through the spaced secondary primers for further detonation of explosive 162 in bore hole 160. In practice, the secondary cast primers have a lesser weight than the basic cast primer 140 in the lower portion of the bore hole. Initiation of element A detonates explosive column 162 in a manner clearly apparent by the drawings. A similar arrangement for using the structure shown in FIG. 9 in a decking arrangement is illustrated in FIG. 13. The secondary cast primers 220 are located in axially spaced explosive charges **162*a* separated by dirt portions 230. Initiation of element A by device 170 fires the explosive charges 162*a*** separately from the bottom of the bore hole to the top thereof.

EXAMPLE AND TESTING

As an example of the present invention, the following energy absorbing detonating device has been produced:

| | Element | Process | lbs/1000 ft |
|---|---|---|---|
| (a) | Center String | Fed longitudinally to assist in feeding PETN | 0.024 |
| (b) | PETN (11.8 grains/ft) Class II Trojan* | Fed around center supporting string | 1.68 |
| (c) | ¼ inch Crepe paper 0.003 inches | Wrapped around said PETN core for supporting core | 0.254 |
| (d) | 10 strands of 1650 Denier Rayon Thread with 1500 filaments each. | Spun around paper tube for tensile strength | 2.040 |
| (e) | Inner Plastic Water Impervious layer (8 mils) (Polyethylene) | Extruded around Rayon threads to protect core from moisture | 1.180 |
| | (Standard Manufacturing Steps to this condition) | | |
| (f) | Overspin of 20/2 rayon yarn | Spun around inner plastic layer. Covers inner plastic layer to form releasable contact with inner plastic layer | 0.893 |

-continued

| Element | Process | lbs/1000 ft |
|---|---|---|
| (g) Outer Plastic layer (42 mils) (Polyethylene) Enerby Absorbing layer. | Extruded over loosely woven rayon yarn | 11.27 |
| | TOTAL | 17.34 |

*Class II Trojan PETN is a fine grain PETN wherein a majority of the material passes through a 325 United States Standard screen.

Elongated detonating devices, constructed in accordance with the above example, were initiated while extending in a confined column of ANFO without detonating the column. Also, a length of the detonating element was twisted three times longitudinally around a length of standard 40 grain/ft detonating cord which was then placed in a 2 inch diameter, 5 feet length of pipe. The pipe was filled with sand and the detonating element was initiated. In these tests, the 40 grain/ft detonating cord was not detonated by the device having the energy absorbing layer in place. To further test the detonating capabilities of the detonating device with the energy absorbing layer in place, the device was spliced to a 50 grain/ft standard detonating cord. In five tests, only twice was the 50 grain cord initiated. Consequently, the detonating element was shown, by these tests, to be a relatively ineffective initiator or detonator for a blasting agent or standard detonating cord when the energy absorbing layer or layers remained intact around the inner detonating cord.

The outer energy absorbing layer or layers were then stripped from the ends of the detonating element constructed in accordance with the above example. The element was spliced with a standard 50 grain/ft detonating cord with the exposed inner plastic layer in contact with the cord. In ten successive tests, initiation of the invention caused initiation of the 50 grain cord. This indicates an increased detonating characteristic for the stripped portion of a detonating device constructed in accordance with the example. In addition, the detonating device was placed in a cast primer of standard PETN, composition B, etc. construction. The initiation of the device was sufficient to detonate the primer without requiring any intermediate charge, such as needed in prior non-electric detonating systems which can detonate in the lower portion of a bore hole.

The present invention was tested in 14 bore holes 70 feet deep filled with ANFO. An elongated element constructed in accordance with the invention extended through the ANFO to a lower one pound cast primer. The upper portion of the elongated detonating device was stripped for initiation and initiated by a trunk line of 30 grain/ft standard detonating cord. Each of the bore holes was detonated from the bottom, indicating that the detonating wave through the invention propagated through the ANFO to the lower cast primer without predetonation at the upper portions of the explosive column. The lower primer had no high energy charge required by other detonating elements allegedly capable of detonating a bore hole charge from a location adjacent the bottom of the bore hole.

Attempts to initiate the detonation element constructed in accordance with the above example without removing the energy absorbing outer layer or layers have proven inconsistent and generally ineffective. It has been found that the energy absorbing layer or layers used to allow bottom detonation must be removed to obtain consistent initiation by standard detonating cord and other common initiating devices.

Having thus defined my invention, I claim:

1. A method of detonating an explosive in a bore hole having an innermost end and an outermost end, said method comprising the steps of:

a. providing a first detonating cord having two ends and a transversely transmittable energy sufficient to detonate said explosive;

b. providing an elongated detonating device having first and second ends and including an inner second detonating cord and an outer energy absorbing layer which device adjacent said layer has a transversely transmittable energy insufficient to detonate said explosive and said first detonating cord;

c. stripping said outer layer from first end of said elongated device;

d. connecting said first end of said elongated device to one end of said first detonating cord;

e. placing said connected end adjacent said innermost end of said bore hole with said second end of said elongated device extending to a position adjacent said outermost end of said bore hole and said first cord extending from said innermost end toward said outermost end of said bore hole; and, f. initiating said second end of said element.

2. A method as defined in claim 1 including the additional steps of:

g. providing a cast primer;

h. extending said elongated device and said first detonating cord through said cast primer; and, i. positioning said cast primer adjacent said innermost end of said bore hole.

3. A method as defined in claim 2 including the additional steps of:

j. providing additional cast primers;

k. positioning said additional cast primers in said bore hole at longitudinally spaced positions therein; and, l. extending said first detonating cored serially through said additional cast primers.

* * * * *